United States Patent [19]

Kronseder et al.

[11] 4,136,719

[45] Jan. 30, 1979

[54] METHOD AND DEVICE FOR CLEANING BOTTLE FILLING MACHINES AND THE LIKE

[75] Inventors: Hermann Kronseder, Wörth, Wilhelm Wiess, Hainsacker, both of Fed. Rep. of Germany

[73] Assignee: Hermann Kronseder, Wörth, Fed. Rep. of Germany

[21] Appl. No.: 875,262

[22] Filed: Feb. 3, 1978

[30] Foreign Application Priority Data

| | | | |
|---|---|---|---|
| Feb. 18, 1977 | [DE] | Fed. Rep. of Germany | 2706925 |
| May 28, 1977 | [DE] | Fed. Rep. of Germany | 7717057[U] |
| Aug. 12, 1977 | [DE] | Fed. Rep. of Germany | 2736332 |

[51] Int. Cl.[2] ..... B65B 3/04; B08B 9/00

[52] U.S. Cl. ..... 141/1; 134/169 C; 141/91; 222/148

[58] Field of Search ..... 134/166 C, 169 C; 141/1, 39–44, 85, 89–92, 285, 325, 392; 137/239, 240; 222/148; 239/119

[56] References Cited

U.S. PATENT DOCUMENTS

| | | | |
|---|---|---|---|
| 3,964,526 | 6/1976 | Sindermann | 141/90 X |
| 3,991,797 | 11/1976 | Uth et al. | 141/91 |
| 4,024,896 | 5/1977 | Ishioka et al. | 141/90 |

*Primary Examiner*—Richard E. Aegerter
*Assistant Examiner*—Frederick R. Schmidt
*Attorney, Agent, or Firm*—Joseph P. House, Jr.

[57] ABSTRACT

A bottle filling machine is adapted for circulating cleaning liquid through its combination gas and liquid storage tank and conduits, filler valves and other fluid passageways communicating therewith at high velocity by partitioning the tank into input and output chambers with a float that is urged into sealing relation by buoyancy and by pressure differential developed on its opposed sides as a result of the pressure drop produced in components that communicate between the chambers.

31 Claims, 15 Drawing Figures

METHOD AND DEVICE FOR CLEANING BOTTLE FILLING MACHINES AND THE LIKE

BACKGROUND OF THE INVENTION

The invention relates to a method and a device for cleaning machines for filling bottles, cans or other containers having a common tank for the liquid and a gas which is injected into the bottles and having filler valves which are connected with the tank by gas and liquid conduits, the gas conduits opening into the tank at a higher level than the liquid conduits. A beer bottle filling machine is an example.

Filling machines having a common tank for the filling liquid and a gas and having filler valves connected with the tank via conduits, are known. Usually the filler valves which couple to the container during filling are arranged in a circle in the center of which is a rotatably mounted tank. This known construction has the advantage that the tank, which is relatively small as compared with the pitch circle of the filler valves, can be produced at low cost. Besides, if necessary, the liquid surface in the tank can be covered almost completely in simplest manner by a float, so that no exchange of gas takes place. However, certain problems arise in the cleaning and sterilization of such known filling machines. When a cleaning liquid is circulated through the tank, the liquid conduits, the interior of the filler valves insofar as accessible, and the gas conduits, these parts are indeed wetted but an appreciable flow velocity in the conduits and filler valves does not occur. The cleaning effect is therefore superficial. It is also difficult to get the dissolved or detached impurities, etc. out of the valve interiors and out of the conduits. Cleaning without disassembly of the filling device is therefore hardly feasible.

SUMMARY OF THE INVENTION

An object of the invention is to provide a method and a device for cleaning a filling machine of the abovementioned kind by means of which the filler valves and the conduits leading to them can be cleaned rapidly and intensively, without requiring disassembly of the machine or any part thereof.

In accordance with the new method, the interior of the tank is divided into two separate chambers, such that the liquid conduits open into the lower chamber and the gas conduits into the upper chamber, that the gas and liquid conduits are interconnected in the area of the filler valves, and that a cleaning liquid is fed into one chamber and removed from the other.

By the temporary partitioning of the tank, which when the machine is operated in its regular container filling mode, has only one chamber, into two separate chambers which are substantially free of liquid interchange and by the special supply and discharge of the cleaning liquid, the gas and liquid conduits are positively traversed by cleaning liquid at high velocity, depending on the pressure of the cleaning liquid, and are therefor cleaned intensively. During the cleaning mode of operation, high fluid pressure is applied in one chamber and, due to pressure drop in the circulation path, lower fluid pressure develops in the other chamber. This pressure differential provides the sealing force for the partition. If the filler valves have a single chamber into which the gas and liquid conduits open, and in which also the liquid discharge valve and the gas discharge valve are accommodated, no special manipulations of the conduit connections are necessary since the cleaning liquid circulation route comes about by itself as the cleaning liquid is supplied. Besides, the filler valve interior is cleaned very well. If such a common chamber does not exist in the filler valves, then, depending on their design, a special cleaning channel may be provided to make circulation of the cleaning liquid possible. In accordance with one version of the invention, if the gas conduit and liquid conduit cannot be put into communication in the filler valve itself, the gas valve and liquid valve are opened simultaneously and bottles or other special cleaning vessels are pressed against the filler valves to effect communication. In all cases a positive flow can be obtained in the particularly critical gas and liquid conduits, and depending on the design of the filler valve, the flow will traverse this valve more or less, especially in the case of the last-named connection by vessels outside the filler valve.

A simple and rapid cleaning mode is made possible when, according to an advantageous variant of the invention, a float movable in the interior of the tank is used to divide the tank into two separate chambers. Especially if the the float is designed so that it largely covers the liquid level in the tank during the normal bottling operation, it can be used very well as a partition for dividing the tank into two chambers during cleaning. To this end, according to a variant of the invention, the float is retained in the tank at a certain level between the inlets of the gas conduits and the inlets of liquid conduits.

If, at least in its partitioning position, the periphery of the float and the interior tank wall are close enough to form a gap seal, no other measures for sealing are necessary, it being assumed that the float itself does not let through any appreciable amount of liquid. However, if no such gap seal exists, or if the capacity of the pump for circulating the cleaning agent is too low to compensate the gap losses, it is desirable, according to another variant of the invention, to seal the float relative to the tank by means of contiguous faces. The sealing may be effected, for example, by the insertion of a lip seal between the tank wall and the float, which remains there during the normal bottling operation but allows the float to move and assume its partitioning position during the cleaning mode. It is possible also to provide special sealing interfaces between the interior of the tank and the float which, during the normal bottling operation, are separated from each other and become operative only in the partitioning position of the float during cleaning. This possibility is useful in particular when, according to another variant of the invention, the float is moved, by means of its buoyancy in the cleaning liquid, upward beyond its normal working position into the partitioning position, and is held there. Fixation of the float in the partitioning position can then be effected by the float and the cooperating seal faces in the tank interior which act as a stop or abutment. With this realization of the invention, the feeding of cleaning liquid can be effected both into the upper chamber, for example, through the gas supply conduit, and into the lower chamber, by way of the feed conduit for the filling liquid. In the second case, the buoyancy of the float is enhanced by the pressure difference in the upper and lower chambers necessarily brought about by the pressure losses in the conduits to the filler valves.

Another variant of the invention consists in that the float is moved, by means of the different pressure in the cleaning liquid at its top and at its underside, beyond the normal working position downward into the partitioning position, and is held there. In this case, the cleaning liquid must be introduced into the upper chamber under pressure and, until it arrives in the lower chamber, must be throttled by appropriate conduit cross-sections in such a way that the pressure difference is sufficient to move the float downward and/or to hold it at a seal face provided there, acting as a stop. This version may be desirable when the construction of the filler valves compels a cleaning liquid flow direction which in the liquid conduits is opposite to the direction of liquid flow during bottling.

With respect to the new apparatus features, the problem of effective cleaning of a filling machine for bottles or the like is solved in a machine having a common tank for the filling liquid and a gas, filler valves which are connected with the tank by gas and liquid conduits, the gas conduits opening into the tank at a highler level than the liquid conduits, and having a float vertically movable in the tank, in that at least one stop or abutment for the float is provided, which fixes the latter in a partitioning position in such a way that it divides the interior of the tank into an upper and a lower chamber, the gas conduits opening into the upper chamber and the liquid conduits into the lower chamber, that seals operative at least in the partitioning position of the float are provided for the liquidproof separation of the two chambers, and that there is formed in the one chamber an inlet and in the other chamber an outlet for a cleaning liquid.

Several advantageous forms of the abutments of the seals are defined in sub-claims.

Another solution of the problem underlying the invention in a filling machine for bottles or the like having a common tank for the filling liquid and a gas, with filling valves which are connected with the tank by gas and liquid conduits, the gas conduits opening into the tank at a higher level than the liquid conduits, consists, according to the invention, in that in the interior of the tank, in the height range between the inlets of the gas conduits and of the liquid conduits, a foil is fastened, that above and/or below the normal height position of the foil a supporting system securing the foil in the partitioning position is secured, and that there is formed in the one chamber formed by the foil and the supporting system an inlet, and in the other chamber, formed by the foil and the supporting system, an outlet for a cleaning liquid.

Another solution of the problem underlying the invention in a filling machine having a common tank for receiving the filling liquid and a gas, and having filler valves which are connected with the tank by gas and liquid conduits, the gas conduits opening into the tank at a higher level than the liquid conduits, consists according to the invention in that a rigid partition is secured in the tank, dividing the interior of the tank into two chambers and interrupted by at least one opening, in such a way that the gas conduits open into the upper chamber and the liquid conduits into the lower chamber, that in the one chamber an inlet, and in the other chamber an outlet is formed for a cleaning liquid, and that the opening in the rigid partition is closable by a valve.

For intensive cleaning it is desirable if, according to a variant of the invention, each filling valve comprises a housing with a closed cavity, into whose lower region the liquid conduit and into its upper region the gas conduit opens. However, the invention is applicable also to other filler valves. In this case, according to another variant of the invention, a closable channel which connects the gas conduit with the liquid conduit is advantageously provided at the filler valves.

For the supply and discharge of the cleaning agent various means are proposed. It is especially expedient if, according to a variant of the invention, the inlet or outlet for the cleaning agent is formed in the lower chamber by the feed line inlet for the filling liquid.

An especially intensive cleaning and flushing at high cleaning liquid flow velocities is made possible in that, according to a variant of the invention, all or several of the filler valves are interconnected by a second gas conduit closable or interrupted by sections, and that the invidivual sections of the second gas conduit communicate with the tank through at least one closable first gas conduit for each. In this way the liquid and gas conduits can be flushed with the filler valves by sections, in that always only one first gas conduit is opened to a certain section of the second gas conduit. This design is especially advantageous for large filling devices with many filler valves and correspondingly long feed lines.

For a more detailed explanation of the invention, several embodiments will be described below with reference to the drawing.

DESCRIPTION OF THE PREFERRED EMBODIMENTS

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
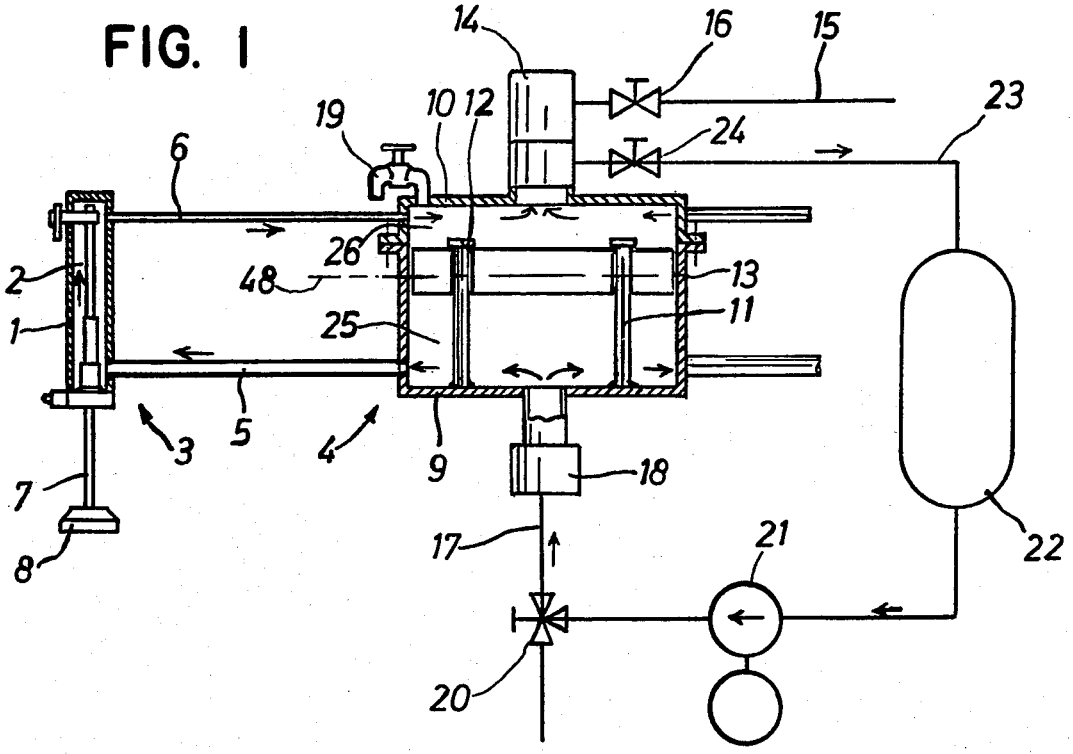
FIG. 1 is a transverse section through a filling device during cleaning with an integrated conduit scheme.

The filling apparatus according to FIG. 1 is set up for the bottling of beer, for example, in glass bottles, not shown, and is part of a rotary filling machine. It comprises a number of filler valves 3 arranged on a pitch circle, a tank 4 situated in the center of the pitch circle for receiving the beer and the counterpressure or pressurizing gas, and a liquid conduit 5 and a gas conduit 6 extending between tank 4 and the filler valves 3. The above-mentioned parts are secured on a rotatable support, not shown, which revolves during bottling.

Each filler valve 3 comprises a block-shaped housing 1 with a continuous closed cavity 2, in which are mounted the liquid valve and the gas valve with their actuating elements. In addition, on each housing 1 a centering bell or bottle coupling head 8 is mounted, displaceable vertically by means of slide bars 7. The liquid delivery conduit 5 to each filler valve 3 opens into the lower end region of cavity 2, while the gas delivery conduit 6 of each filler valve 3 opens into the upper end region of cavity 2. In this cavity, approximately the same liquid level establishes itself as in tank 4.

The substantially cylindrical tank 4 comprises a pot type bottom part 9 and a cover type top part 10, separated by a horizontal joint. The liquid conduits 5 open into the lower region of the bottom part 9, while the gas conduits 6 open into the top part 10. The bottom part 9 and top part 10 are coupled together in pressure-tight relation and there is a seal gasket, not shown, between them. On the floor of the bottom part 9 are secured several vertical bars 11, each with a collar 12 located at the same height. On these bars 11, below the collars 12, there is a float 13 having matching bores to guide it for vertical movement on the bars. The float 13 consists, for example, of two half-shells welded together and may be filled with a plastic foam for stiffening. Its outside diameter is only slightly smaller than the inside diameter of tank 4 or respectively of the coincident inside diameter of the bottom part 9 and top part 10, so that during bottling it covers the surface of the beer level in tank 4 almost completely and that a sliding gap seal is formed between its cylindrical outer face and the cylindrical inner face of tank 4.

The beer level in tank 4 is regulated during bottling by a level control 14 which actuates the supply and discharge of pressurizing gas supplied by a conduit 15 in which there is a manual stop valve 16. The beer moves up via a beer conduit 17 opening into the floor of the bottom part 9 and having a rotary seal 18.

During bottling, the desired normal beer level establishes itself with certain fluctuations. The top of float 13 is then situated approximately on the level of the dash-dot line 48. The gas pressure in the upper part of tank 4 can act fully on the float 13 or respectively on the beer level, as is necessary for liquid level regulation and satisfactory bottling. The fluid level is similar in the interior of the filler valves 3. The stop collars 12 on the bars 11 are arranged so that they do not hinder the normal float movement during bottling.

When the filling device according to FIG. 1 is to be cleaned, first the filling liquid, such as beer, is drained to the extent possible. Then, by the admission of water or the like at a suitable point such as through valve 20 of the beer conduit 17, preflushing is carried out. To this end it is necessary to close valve 16 in the pressurizing gas conduit 15. Because there is now no counter pressure, tank 4 can fill with water completely. This causes the float 13 to go up until it strikes against the collars 12 acting as stop, being retained there by its buoyancy and positive liquid pressure underneath it. The interior of the tank 4 is thereby divided and substantially partitioned into an upper chamber 26 and a lower chamber 25, with the gas conduits 6 opening into the upper chamber 26 and the liquid conduits 5 into the lower chamber 25 due to an appropriate arrangement of the collars 12. By the gap seal formed between the tank wall and the float jacket and by the collars 12 closing the bores in float 13, the two chambers are separated so they will not interchange liquid, except for slight gap losses. Further flow of the water into tank 4 is now possible only by the detour via the liquid conduits 5, the cavities 2 in the filler valves 3, and the gas conduits 6. These passages, therefore, are flushed positively. Discharge of the flush water can occur, for example, through a cock 19 installed in the top part 10 of tank 4, which also provides for the venting.

A similar situation prevails during a subsequent disinfection or sterilization by circulation of a liquid cleaning agent. To this end, the beer conduit 17 is connected via a three-way cock 20 to a circulating pump 21, which is supplied with the cleaning agent from a tank 22. The return flow here occurs advantageously through a separate flush line 23 of adequate cross-section, in which a valve 24 is installed and which opens into tank 22. The cleaning agent is forced via the beer conduit 17 into the lower chamber 25 of tank 4 partitioned off by float 13, and thence via the liquid conduits 5, the cavities 2 and the gas conduits 6 into the upper chamber 26, in order then to flow via an outlet opening in the top part 10 of the tank and a rotary seal into the flush line 23 and back to tank 22. Thus a closed circulation path can be maintained, in which all essential parts of the filling device are included and wherein at correspondingly high pressure very high flow velocities can be attained. The liquid valves of the filler valves 3 must then, of course, remain closed as must the air valves. Because of the pressure drop occurring in the conduit 5, filler valve 3 and conduit 6, there will always be positive pressure in the lower chamber 25 relative to upper chamber 26. This pressure differential assures that float 13 will remain buoyed and act as a partitioning seal regardless of the pressure and velocity of the liquid cleaning agent.

Figures 3, 4:
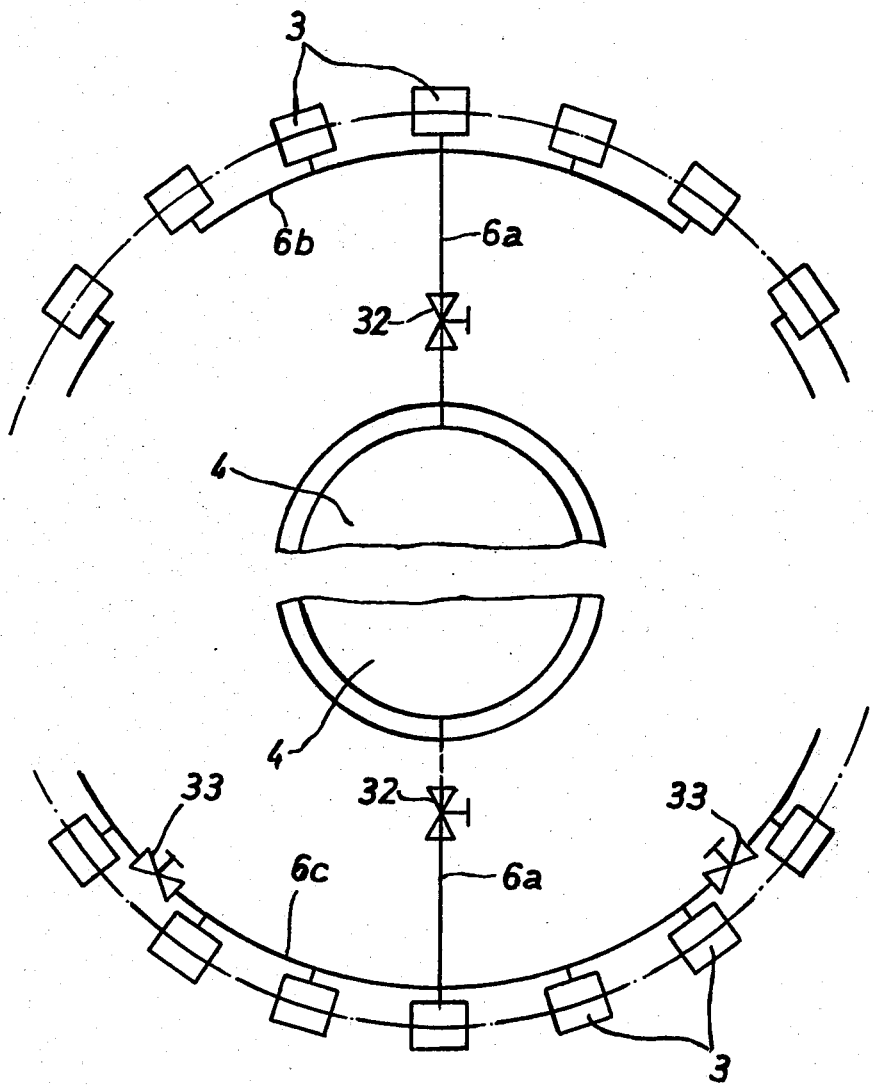
FIG. 3 is a partly schematic plan view of a filling device according to FIG. 1 with modified gas conduits.
FIG. 4 is a partly schematic plan view of a filling device according to FIG. 1 with modified gas conduits.

If very many filler valves 3 and long conduits 5, 6 must be cleaned and/or if a high pressure cannot be applied, the filler valves 3 may be grouped together in sections. FIGS. 3 and 4 show two such arrangements for the gas conduits. In FIG. 3, five filling valves 3 are interconnected by a second gas conduit 6*b*, the connection with tank 4 occurring through a single first gas conduit 6*a* closable by a valve 32. In the filling device according to FIG. 4, all filler valves 3 are interconnected by a second gas conduit 6*c*, a valve 33 being inserted after each group of five filling valves 3. Each section of the second gas conduit 6*c* is connected with tank 4 by a first gas conduit 6*a* with a valve 32. During bottling, all valves 33 and 32 are here open. During cleaning, each section comprising five filler valves 3 can be flushed separately, in that only the associated valve 32 in gas conduit 6*a* is open and the two adjacent valves 33 in the second gas conduit 6*c* are closed. Similar arrangements are possible also with the liquid conduits, not shown, in FIGS. 3 and 4.

Figure 2:
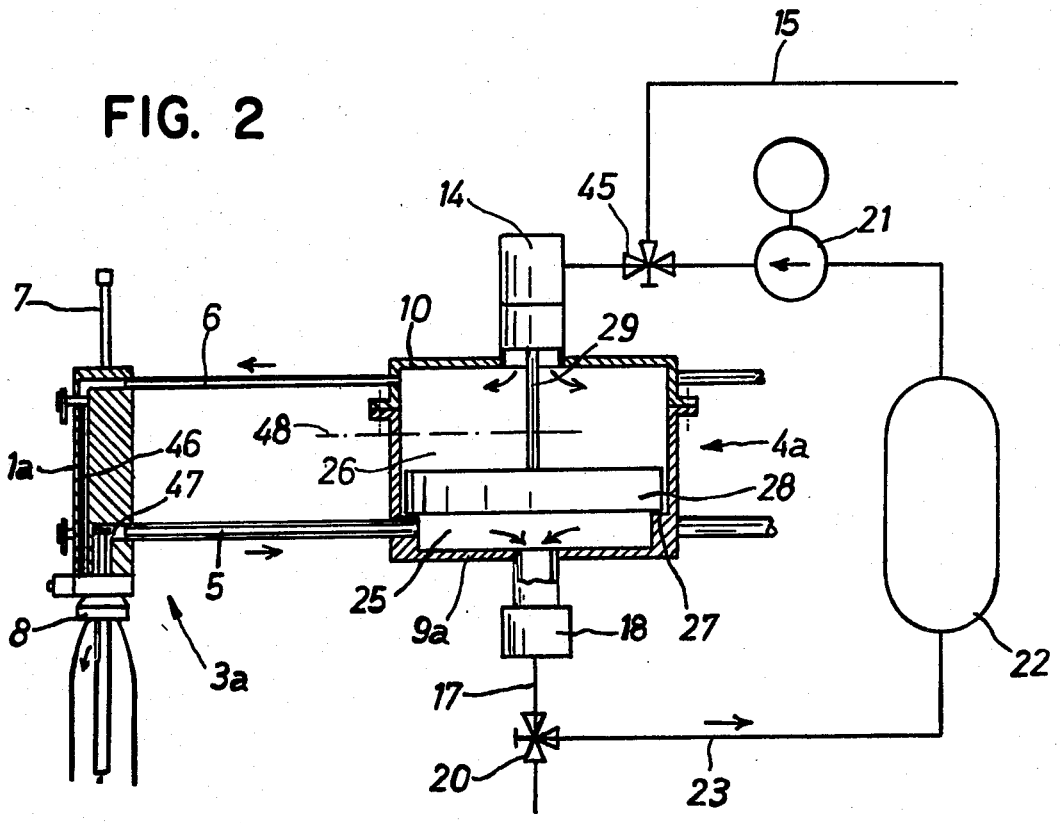
FIG. 2 is a transverse section through another filling device during cleaning with an integrated conduit scheme.

The filling device shown in FIG. 2 is in part identical with the filling device shown in FIG. 1; therefore only the differences between them will be described. Here the bottom part 9*a* of tank 4*a* is provided in the region of the inlets of the liquid conduits 5 with an annular shoulder 27, whose upper ring face, lying essentially horizontally above the inlets of the liquid conduits 5, serves as abutment and seal face. Above this shoulder 27, a float 28 is movable vertically in the interior of the tank. The outside diameter of the substantially cylindrical float 28 is greater than the smallest diameter of shoulder 27 or respectively its ring face. In the center of float 28 a bar 29 is fastened, which cooperates with the level control 14 and also guides the float 28. During bottling, the top of float 28 is approximately at the level of the line 48 shown as a dash-dot line. The pressure side of the circulating pump 21 is connected via a three-way cock 45 to the pressurizing gas conduit 15. Admission of the cleaning agent thus occurs via the pressurizing gas conduit 15 opening into the top part 10, whereas the flush line 23 leading to tank 22 is connected to the beer conduit 17 via the three-way cock 20.

In the filling device shown in FIG. 2, the cleaning operation takes place as follows: After the beer has been drained, float 28 sinks by gravity effect of its own weight, until it rests on the ring face of shoulder 27. The tank interior is now divided into an upper chamber 26 and a lower chamber 25, with the gas conduits 6 opening into the upper chamber 26 and the liquid conduits 5 into the lower chamber 25. By the ring face of shoulder 27 and the matching counterface of float 28 the two chambers 25 and 26 are separated from each other in a substantially leakproof fashion. As cleaning liquid is being added into the upper chamber 26, the pressure of float 28 against shoulder 27 is intensified due to the pressure difference at the top and at the underside of float 28. This pressure difference continues to exist after complete filling of the filling device with cleaning liquid, because due to the losses incidental to flow in conduits 5 and 6 and in the interior of the filling valves 3*a* the pressure of the cleaning liquid is much lower in the lower chamber 25 than in the upper chamber 26. Therefore, float 28 cannot lift off.

Unlike the filler valve 3 in FIG. 1, the filler valve 3*a* in FIG. 2 does not have a cavity connecting the gas and liquid conduits 5 and 6, but has separate channels 46 and 47 for the liquid and the gas in the valve housing 1*a* with the corresponding gas and liquid valves. The connection of the two conduits 5 and 6 here occurs via a bottle, shown fragmentarily, pressed against the filler valve 3*a*, the gas valve and the liquid valve being open. The cleaning liquid then flows through the gas conduit 6, the gas channel 46 and the gas valve arranged therein in the valve housing 1*a* into the bottle and thence back via the filling pipe or respectively the liquid valve and the liquid channel 47 formed in the interior of the valve housing 1*a* as well as the liquid conduit 5 into the lower chamber 25. It is especially advantageous here that all parts of the filler valve 3*a* are positively traversed and are therefore cleaned extremely well. Instead of coupling the gas and liquid conduits with a bottle during the cleaning operation, it is possible also to arrange in the interior of the valve housing 1*a* a transverse channel, not shown, connecting the two channels 46 and 47 and having a shut-off member, which is opened during cleaning. In this case, the liquid valve and the gas valve must be maintained closed during cleaning.

In the following, the various embodiments according to FIGS. 5 to 15 will be described, only the differences from the embodiment shown in FIG. 1 being elucidated.

Figure 5:
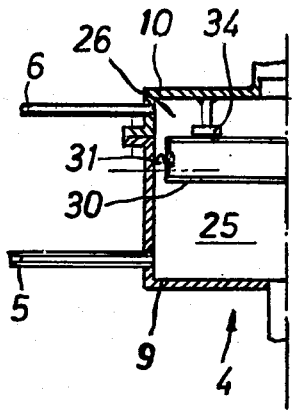
FIG. 5 to FIG. 15 are partial transverse sections through various other filling devices.

In the filling device shown in FIG. 5, a pliable lip seal 31 which could be an O-ring, which presses against the cylindrical wall of tank 4 and which slides with float 30, is secured on the outer edge of float 30 in an annular groove. The stop position of float 30 in which it divides the interior of the tank into two chambers 25, 26 is established by strike plates 34 fastened to the top part 10 of the tank. Liquid separation in the two chambers is effected by the seal 31.

Figure 6:
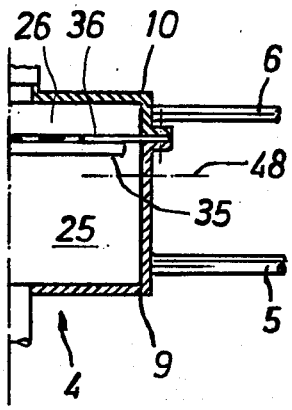

In the filling device shown in FIG. 6, the float 35 is formed by a relatively thin plastic disk. Float 35 is stopped in the separating position with a perforated sheet metal disk 36, which is firmly clamped between the top part 10 and bottom part 9 of tank 4. When float 35 bears up against the sheet metal disk 36 from below due to the buoyancy in the cleaning liquid, the holes of the disk are covered up and sealed, whereby the tank 4 is divided into two chambers 26, 25. Float 35 should be flexible enough to conform with disk 36 and seal its perforations in this embodiment.

Figure 7:
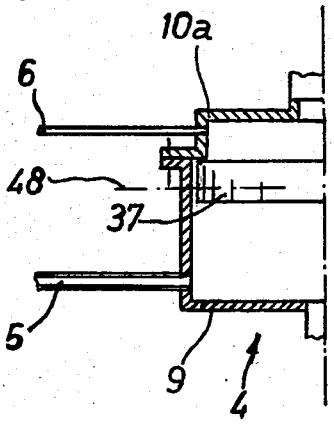

In the filling device shown in FIG. 7, the inside diameter of the top part 10*a* of tank 4 is somewhat smaller than that of the bottom part 9. The projection formed thereby, protruding into the interior of the tank, serves as the abutment or stop and seal face for float 37 when the latter is lifted by the cleaning liquid. Accordingly, the outside diameter of float 37 is somewhat greater than the inside diameter of the top part 10*a*.

Figure 8:
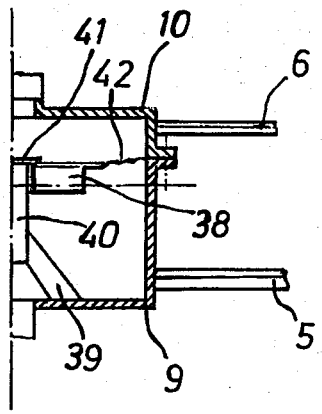

In the filling device shown in FIG. 8, the float 38 is annular and is displaceable in its bore on a vertical guide bar 40 secured by means of supports 39 on the floor of the bottom part 9. At the upper end of the guide bar 40, a collar type stop 41 is formed, by which the separating position of float 38 is established and sealing of the float bore is effected. The seal between float 38 and the tank wall here occurs by an annular, elastic or corrugated foil 42 clamped on the one hand at the float 38 and on the other at the tank 4.

Figure 9:
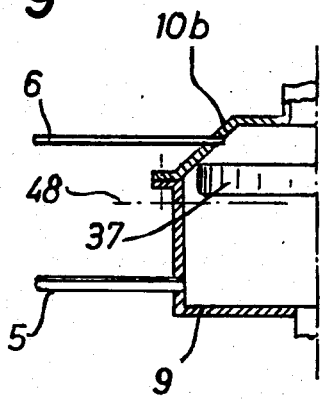

The design of the filling device shown in FIG. 9 is similar. Here the abutment and seal face for float 37 is formed by the upwardly tapering conical side wall of the top part 10*b*.

In all embodiments described until now, the tank and the float are designed essentially rotation-symmetrically, and except for any bearing bores for the guide bars, the float has no other apertures that would permit passage of liquid between the two chambers 25 and 26. In each instance the normal position of the top of the float during filling is indicated by a dash-dot line 48; what is shown is the tank separating position of the float during the cleaning process.

Figure 10:
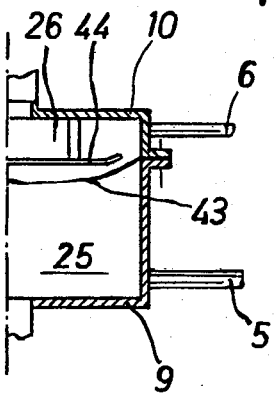

In the embodiment shown in FIG. 10, a float in the conventional sense was dispensed with. Instead, there is clamped between the top part 10 and bottom part 9 of tank 4 a circular foil 43 which during filling completely covers the beer level. The separating position of this foil 43 is established by a supporting disk 44 secured on the top part 10. Due to the pressure difference in the two chambers 25 and 26, foil 43 is forced against this supporting disk 44 and thus cannot be damaged. The normal position during bottling is shown.

Figure 11:
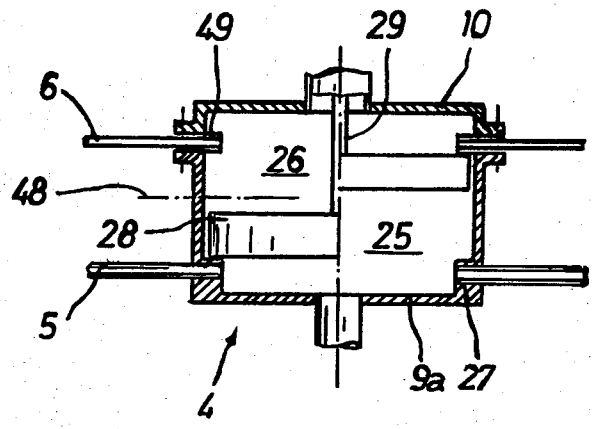

The filling device shown in FIG. 11 is essentially equivalent to the filling device according to FIG. 2, that is, a shoulder 27 in the bottom part 9*a* of tank 4 constitutes an abutment and seal face for the float 28, which lies below the normal position of the float indicated by line 48. Additionally, a second abutment and seal face is provided here, lying above the normal position of float 28. It is formed by the lower face of a ring 49 which is clamped between the bottom part 9*a* and top part 10 of tank 4. The gas conduits 6 lead into this ring. The inside diameter of ring 49 is smaller than the outside diameter of float 28. In this embodiment, float 28 can be brought selectively into the lower separating position (see left side of FIG. 11) or into the upper separating position (see right side of FIG. 11) depending upon the desired direction of flow or the given pressure conditions in tank 4. It is thus possible to flush alternately in different directions during cleaning, the float 28 being buoyed into the upper separating position (similar to FIG. 1) and by the negative pressure differential on its underside into the lower separating position (similar to FIG. 2). A particularly intensive cleaning is possible thereby.

Figure 12:
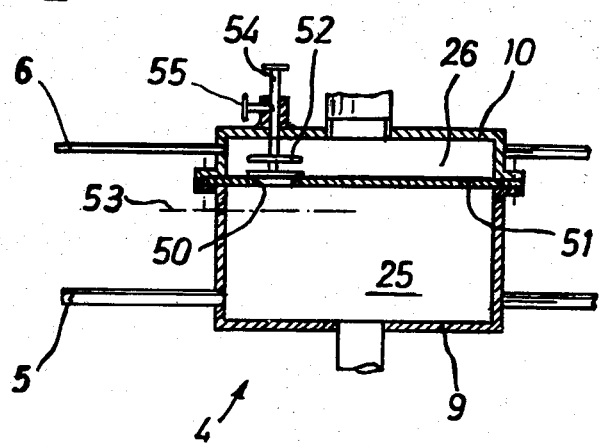

In the filling device according to FIG. 12, there is no element covering the liquid level during filling. Instead, a circular separating disk 51, equipped with an eccentrically placed opening 50, is clamped between the top part 10 and bottom part 9 of tank 4. This opening 50 is free during the bottle filling operation, so that the passage of gas or liquid, depending on the position of the liquid level 53, is not impeded. But for cleaning, the opening 50 is closed in leakproof fashion by a plate 52. Plate 52 is secured on an actuating bar 54 which is displaceable in the top part 10 and which can be fixed in the open position and in the closed position shown in dash-dot lines, for example, by a stud 55 engaging in recesses in bar 54. The division of the interior of the tank for cleaning purposes into a lower chamber 25 and an upper chamber 26 is thus effected by the separating plate 51 together with disk 52. Disk 52 is preferably arranged on the side of plate 51 where the higher pressure prevails during cleaning, so that the contact pressure is intensified. It is also possible to provide two plates 52 at the actuating bar 54, one below and one above disk 51.

Figure 13:
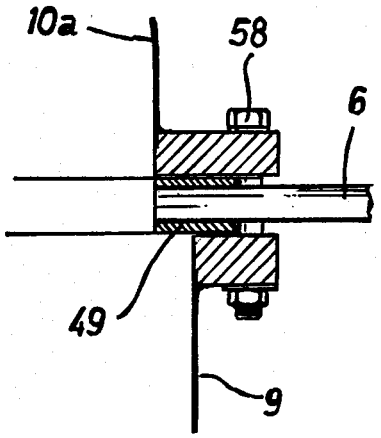

In the filling device shown fragmentarily in FIG. 13, similar to FIG. 11, a ring 49 lying above the normal position of the float is provided, whose underside projecting into the interior of the tank serves as abutment and seal face and into which the gas conduits 6 open. Centering of the ring 49 is effected by the bolts 58 connecting the top part **10*a* and the bottom part 9. Similar to FIG. 7, the top part 10*a* has a smaller diameter than the bottom part 9 and the inside diameter of the top part 10*a* matches the inside diameter of the ring 49. Ring 49, therefore, is completely covered and supported upwardly by the top part 10*a***.

Figure 14:
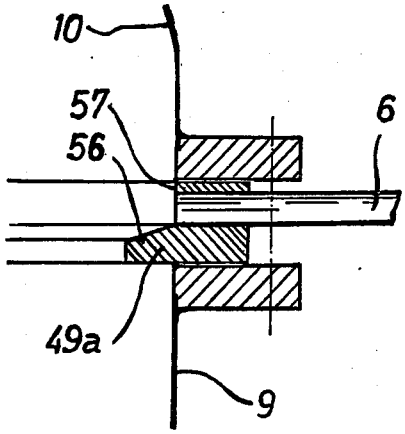

Also in the filling device shown in FIG. 14, a ring **49*a* protruding into the interior of the tank is provided, whose underside forms an abutment and seal face for the float and into which the gas conduits 6 open. However, the ring 49*a* is provided on its top at the level of the gas conduits 6 with a shoulder 57, whose inside diameter matches that of the top part 10 or respectively bottom part 9. In this way there is formed below the gas conduits 6 a projection protruding into the interior of the tank, the top side of which is provided with a bevel 56**.

Figure 15:
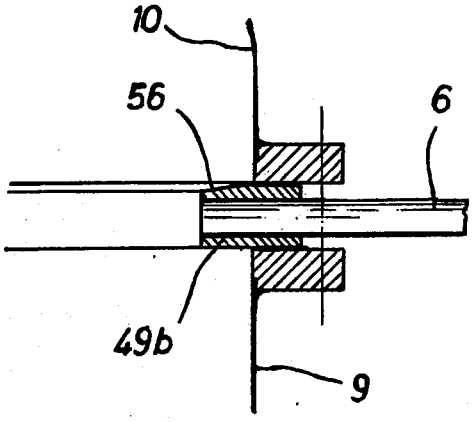

The filling device shown fragmentarily in FIG. 15 is similar to the one shown in FIG. 11 with respect to the arrangement of an upper stop for the float. However, in the upper region of ring **49*b*, protruding into the interior of the tank, a bevel 56 inclined toward the center of the tank is formed. It facilitates the dripping of liquid from ring 49*b***.

We claim:

1. Apparatus for filling bottles and other containers with liquid including a common tank for the filling liquid and gas, at least one filler valve having an inlet for filling liquid and an inlet for gas, said inlet for gas being coupled to said tank at a higher level than the inlet for said filling liquid, a float arranged for vertical movement in said tank, improved means for cleaning said apparatus by circulating cleaning fluid through it in the absence of said filling liquid and gas, comprising:

means for limiting the movement of said float in one direction to a position for said float to partition said tank into upper and lower chambers and for said gas inlet to said filler valve to communicate with said upper chamber and said filling liquid inlet of said filler valve to communicate with said lower chamber, inlet means for introducing pressurized cleaning fluid into one of said chambers and outlet means for exhausting simultaneously said cleaning fluid from the other of said chambers.

2. The apparatus as in claim 1 including sealing means operative at least when said float is being limited in said one direction to effect a seal between said chambers.

3. The apparatus as in claim 1 wherein said float in said tank has the configuration of the interior of said tank but is slightly smaller to form a sealing gap between it and said tank.

4. The apparatus as in claim 1 including means in said tank for guiding said float to move vertically and for stopping said float in the position in which it partitions said tank into said two chambers, and a flexible and extensible diaphragm means disposed around said float and being sealed to said float and the interior of said tank.

5. The apparatus as in claim 4 wherein said diaphragm means is a corrugated foil.

6. The apparatus as in claim 1 wherein said means for limiting movement of said float comprises stop means in one of said chambers against which said float abuts, and an elastic sealing ring secured to said float and surrounding said float to effect a sliding seal in cooperation with the interior of said tank.

7. The apparatus as in claim 1 wherein said means for limiting movement of said float comprises stop means disposed circumferentially about the interior of said tank and extending radially inwardly thereof, to present a sealing surface for said float to engage with and effect a seal when said float is in its partitioning position.

8. The apparatus as in claim 1 wherein the interior of said tank and said float are both circular, said float having a slightly smaller diameter than said tank interior for developing a sealing gap therewith.

9. The apparatus as in claim 1 including means for guiding said float to move vertical and for maintaining said float in slidable contact with the interior of said tank.

10. The apparatus as in claim 1 wherein said means for limiting movement of said float is an annular shoulder means projecting into the interior of said tank for said float to engage with said shoulder and effect a seal when said float is in its partitioning position.

11. The apparatus as in claim 1 wherein said means for limiting movement of said float comprises at least one vertical guide bar means fixed in said tank along which said float may move, and stop means on said guide bar means.

12. The apparatus as in claim 1 wherein said means for limiting movement of said float comprises at least one vertically disposed elongated means against which said float can abut, said elongated means projecting into said chamber which has said cleaning fluid outlet means.

13. The apparatus as in claim 12 including means supporting said elongated means in a wall of said tank for adjusting the position of said elongated means in said chamber.

14. The apparatus as in claim 1 wherein said means for limiting movement of said float is constituted by shaping one of the upper and lower portions of said tank as a cone for said float to enter and be limited in movement to form said partition.

15. The apparatus as in claim 1 wherein said means for limiting movement of said float is a plate means extending across the interior of said tank and having perforations, said float being movable against said plate means under the influence of said pressurized cleaning liquid to close said perforations.

16. The apparatus as in claim 1 including conduit means coupling said liquid and gas inlets of said filler valve means to said tank and projecting into said tank to serve as stop means for limiting movement of said float.

17. The apparatus as in claim 1 including another means for limiting movement of said float in a direction opposite of said one direction, said float being movable between the one and said another means to enable establishing said float in two different partitioning positions to facilitate circulating said cleaning fluid in reversed directions, one of said positions being above and the other below the position occupied by said float when said apparatus is used for filling containers.

18. Apparatus for filling bottles and other containers with liquid including a common tank for the filling liquid and the gas, a plurality of filler valves each having an inlet for gas and an inlet for filling liquid, and closable outlet means for discharging gas and filling liquid to said containers, first conduit means for communicating said inlet for gas with said tank at one level of said tank and second conduit means for communicating said inlet for liquid at a level of said tank which is lower than said one level, means for defining within said tank an upper chamber for being occupied by gas and a lower chamber for being occupied by filling liquid during the normal container filling operation, said defining means permitting direct mutual communication of the pressure of the gas and liquid during the normal filling operation, gas feed conduit means coupled with said upper chamber and filling liquid feed conduit means coupled with said lower chamber, and improved means for cleaning said apparatus by circulating cleaning fluid at least through the aforesaid filler valves, and said first and second conduit means and said chambers, comprising:

means for controlling said chamber defining means to maintain the volume of said chambers constant in the absence of said filling fluid and said gas, inlet means for introducing cleaning fluid to one of said chambers and outlet means for exhausting said cleaning fluid from the other of said chambers after said cleaning fluid has circulated through said filler valve means and said first and second conduit means, and means for interrupting the direct pressure communication between the fluid in said chambers during introduction of said cleaning fluid for a pressure differential to occur between the fluid in said chambers, respectively.

19. The apparatus as in claim 18 including:

means for closing said gas feed conduit means and said liquid feed conduit means when said cleaning fluid is being circulated, a cleaning fluid circulating loop comprising a pump, a cleaning fluid storage container, and conduit means connected in series with each other between said inlet for cleaning fluid to one chamber and said outlet for cleaning fluid from said other chamber, said pump having an input connected through said loop for effecting relatively low cleaning fluid pressure in one of said chambers and having an output connected through said loop for effecting relatively higher pressure in the other of said chambers.

20. The apparatus as in claim 18 wherein:

said chamber defining means comprises a float that is vertically movable in said tank in substantial sealing relationship therewith in response to the pressure differential between said filling liquid and gas during the container filling operation and to the pressure differential between the cleaning fluid in said chambers during the cleaning operation, and stop means for stopping movement of said float means in response to pressurized cleaning fluid being introduced into one chamber to thereby maintain the size of said chambers.

21. The apparatus as in claim 18 wherein:

said means for defining said tank into chambers comprises a float that is vertically movable in said tank in response to the pressure differential between said filling liquid and gas during the container filling operation and in response to pressure differential between the cleaning fluid in said chambers during the cleaning operation, annular stop means extending into the path of said float for limiting its movement when urged to move by introduction of pressurized cleaning fluid into one chamber and providing a surface for said float to seal on when said float is urged toward it by said fluid.

22. The apparatus as in claim 18 wherein:

said chamber defining means comprises flexible diaphragm means extending across the interior of said tank with its margin sealed to the tank and arranged to yield in opposed vertical directions in response to pressure differential between said filling liquid and said gas during the container filling operation, and stop means disposed in said tank on a side of said diaphragm from which said cleaning fluid exhausts for limiting the amount of yield by said diaphragm when it is subjected to pressurized cleaning fluid applied to its other side.

23. The apparatus as in claim 18 wherein:

said chamber defining means comprises plate means extending crosswise of the interior of said tank and having perforations, a float disposed in one of said chambers and movable in response to introduction of pressurized cleaning fluid in one chamber to be stopped by said plate and to close said perforations and maintain the size of said chambers.

24. The apparatus as in claim 18 wherein:

said gas feed conduit means is coupled to said inlet means for said upper chamber and a separate conduit means is coupled to said gas feed conduit means for exhausting said cleaning liquid, and said filling liquid feed conduit means is coupled to said inlet means of said lower chamber and a separate conduit means is coupled to said filling fluid feed conduit means for supplying said cleaning fluid.

25. The apparatus as in claim 18 wherein:

a valve is coupled to said outlet for cleaning fluid to enable exhausting said fluid into open space.

26. The apparatus as in claim 18 including:

third conduit means interconnecting several of said filler valves, means for closing said third gas conduit means in sections, and said first conduit means respectively connecting each of said sections to said tank.

27. The apparatus as in claim 18 wherein:

said means for defining said tank into upper and lower chambers comprises a float vertically movable in said tank, said tank being comprised of top and bottom parts, annular ring means clamped between said parts and projecting into the interior of the tank, said ring means being positioned for stopping movement of said float and effecting a seal with said float when said float is subjected to pressurized cleaning fluid in one chamber, said ring means having gas outlet means communicating with said tank and having gas inlet means, said gas feed conduit being connected to said gas inlet means.

28. The apparatus as in claim 18 wherein:

said means for defining said tank into upper and lower chambers comprises a float vertically movable in said tank, said tank being composed of upper and lower parts, a ring clamped between said parts and having a portion projecting into said tank and having an opening in said tank smaller than the size of said float for said ring to stop said float, effect a seal therewith and define the size of said chambers, said seal being effected by said pressurized cleaning fluid acting on one side of said float.

29. The apparatus as in claim 28 wherein said ring has a bevel slanting toward the interior of said tank.

30. The apparatus as in claim 28 wherein the inside diameter of said ring matches the inside diameter of the top part of said tank.

31. A method of cleaning filling apparatus for bottles and other containers in which there is a common tank for filling fluid and gas which is to be put into said containers and filler valves connected with said tank by a conduit for gas and a conduit for filling liquid, said conduit for gas opening into said tank at a higher level than said conduit for filling liquid, said cleaning method comprising the steps of:

partitioning said tank into separate upper and lower chambers for said conduit for gas to communicate with said upper chamber and said conduit for liquid to communicate with said lower chamber, causing said conduits to communicate with each other through said filler valve, and feeding cleaning fluid into one chamber for circulation therefrom through said conduits and filler valve back to the other chamber, and enabling said fluid to flow out of said other chamber.

* * * * *